US005677262A

United States Patent [19]

Mruk et al.

[11] Patent Number: 5,677,262

[45] Date of Patent: Oct. 14, 1997

[54] PROCESS FOR OBTAINING LOW GLOSS RECEIVING ELEMENT FOR THERMAL DYE TRANSFER

[75] Inventors: William Andrew Mruk; Bruce Crinean Campbell, both of Rochester, N.Y.

[73] Assignee: Eastman Kodak Company, Rochester, N.Y.

[21] Appl. No.: 620,091

[22] Filed: Mar. 21, 1996

Related U.S. Application Data

[60] Provisional application No. 60/001,582, Jul. 27, 1995.

[51] Int. Cl.[6] ..... B41M 5/035; B41M 5/38

[52] U.S. Cl. ..... 503/227; 156/219; 156/220; 156/221; 428/195; 428/211; 428/215; 428/216; 428/304.4; 428/409; 428/913; 428/914

[58] Field of Search ..... 8/471; 428/195, 428/409, 913, 914, 211, 213, 215, 216, 304.4, 334–336; 503/227; 156/219–221; 427/299, 326

[56] References Cited

U.S. PATENT DOCUMENTS

| | | | |
|---|---|---|---|
| 4,774,224 | 9/1988 | Campbell | 503/227 |
| 5,135,905 | 8/1992 | Egashira et al. | 503/227 |
| 5,244,861 | 9/1993 | Campbell et al. | 503/227 |

*Primary Examiner*—Bruce H. Hess
*Attorney, Agent, or Firm*—Harold E. Cole

[57] ABSTRACT

A process for obtaining a low gloss, dye-receiving element for thermal dye transfer comprising extrusion laminating a support with 1) a polyolefin resin and 2) a composite film comprising a microvoided thermoplastic core layer and a substantially void-free thermoplastic surface layer, the extrusion laminating process being performed with an embossed chill roll having a surface roughness average (Ra) of at least 1.5 μm and a pressure roll, and then coating the composite film with a polymeric dye image-receiving layer, thereby producing the low gloss, dye-receiving element.

8 Claims, No Drawings

PROCESS FOR OBTAINING LOW GLOSS RECEIVING ELEMENT FOR THERMAL DYE TRANSFER

CROSS REFERENCE TO RELATED APPLICATION

Reference is made to and priority claimed from U.S. Provisional Application Ser. No. U.S. 60/001,582, filed 27 Jul. 1995, entitled PROCESS FOR OBTAINING LOW GLOSS RECEIVING ELEMENT FOR THERMAL DYE TRANSFER.

This invention relates to a process for obtaining a low gloss, dye-receiving element used in thermal dye transfer, and more particularly to such receiving elements containing microvoided composite films with a low gloss surface.

In recent years, thermal transfer systems have been developed to obtain prints from pictures which have been generated electronically from a color video camera. According to one way of obtaining such prints, an electronic picture is first subjected to color separation by color filters. The respective color-separated images are then converted into electrical signals. These signals are then operated on to produce cyan, magenta and yellow electrical signals. These signals are then transmitted to a thermal printer. To obtain the print, a cyan, magenta or yellow dye-donor element is placed face-to-face with a dye-receiving element. The two are then inserted between a thermal printing head and a platen roller. A line-type thermal printing head is used to apply heat from the back of the dye-donor sheet. The thermal printing head has many heating elements and is heated up sequentially in response to the cyan, magenta and yellow signals. The process is then repeated for the other two colors. A color hard copy is thus obtained which corresponds to the original picture viewed on a screen. Further details of this process and an apparatus for carrying it out are contained in U.S. Pat. No. 4,621,271, the disclosure of which is hereby incorporated by reference.

Dye-receiving elements used in thermal dye transfer generally comprise a polymeric dye image-receiving layer coated on a base or support. In a thermal dye transfer printing process, it is desirable for the finished prints to compare favorably with color photographic prints in terms of image quality. The look of the final print is very dependent on surface texture and gloss of the receiver support. Typically, color photographic prints are available in surface finishes ranging from very smooth, high gloss to rough, low gloss matte.

U.S. Pat. No. 5,244,861 discloses dye-receiving elements wherein a dye image-receiving layer is coated onto a composite film laminated to a support. The composite film comprises a microvoided thermoplastic core layer and at least one substantially void-free thermoplastic surface layer. However, there is a problem with these receivers in that they have a high gloss surface and creating a low gloss, matte type surface would require an additional coating layer and/or modifications to the dye image-receiving layer which would increase both manufacturing cost and process complexity.

U.S. Pat. No. 4,774,224 discloses a process for preparing a dye-receiver element where a paper support is extrusion-overcoated with polyethylene using a chill roll and a pressure roll to obtain a low gloss surface. The low gloss surface is easily obtained in this process since the polyethylene is molten at the time it passes through the nip formed by the chill roll and pressure roll. However, there is no disclosure in this patent that this technique could be used for polymer layers which are not molten at the time of lamination.

It is an object of this invention to provide a process for obtaining a low gloss surface on a dye-receiving element having a composite film of a microvoided thermoplastic core layer and at least one substantially void-free thermoplastic surface layer. It is another object of the invention to provide such a process without having to employ an additional coating layer or to modify the dye image-receiving layer.

These and other objects are achieved in accordance with the invention, which comprises a process for obtaining a low gloss, dye-receiving element for thermal dye transfer comprising extrusion laminating a support with 1) a polyolefin resin and 2) a composite film comprising a microvoided thermoplastic core layer and a substantially void-free thermoplastic surface layer, the extrusion laminating process being performed with an embossed chill roll having a surface roughness average (Ra) of at least 1.5 μm and a pressure roll, and then coating the composite film with a polymeric dye image-receiving layer, thereby producing the low gloss, dye-receiving element.

It was not thought that embossed chill rolls having a certain surface roughness would have any effect on a thermoplastic layer of a composite film at room temperature, which is not molten at the time of extrusion lamination. However, in the process of the invention, the embossed chill roll was found to have an effect on the surface of a composite film and could be used to provide a low gloss film, provided that the Ra of the embossed chill roll is at least 1.5 μm.

Due to their relatively low cost and good appearance, composite films are generally used and referred to in the trade as "packaging films." The support may include cellulose paper, a polymeric film or a synthetic paper. A variety of dye-receiving layers may be coated on these bases.

Unlike synthetic paper materials, microvoided packaging films can be laminated to one side of most supports and still show excellent curl performance. Curl performance can be controlled by the beam strength of the support. As the thickness of a support decreases, so does the beam strength. These films can be laminated on one side of supports of fairly low thickness/beam strength and still exhibit only minimal curl.

The low specific gravity of microvoided packaging films (preferably between 0.3–0.7 g/cm$^3$) produces dye-receivers that are very conformable and results in low mottle-index values of thermal prints as measured on an instrument such as the Tobias Mottle Tester. Mottle-index is used as a means to measure print uniformity, especially the type of nonuniformity called dropouts which manifests itself as numerous small unprinted areas. These microvoided packaging films also are very insulating and produce dye-receiver prints of high dye density at low energy levels. The nonvoided skin produces receivers of high gloss and helps to promote good contact between the dye-receiving layer and the dye-donor film. This also enhances print uniformity and efficient dye transfer.

Microvoided composite packaging films are conveniently manufactured by coextrusion of the core and surface layers, followed by biaxial orientation, whereby voids are formed around void-initiating material contained in the core layer. Such composite films are disclosed in, for example, U.S. Pat. No. 5,244,861, the disclosure of which is incorporated by reference.

The core of the composite film should be from 15 to 95% of the total thickness of the film, preferably from 30 to 85% of the total thickness. The nonvoided skin(s) should thus be from 5 to 85% of the film, preferably from 15 to 70% of the thickness. The density (specific gravity) of the composite film should be between 0.2 and 1.0 g/cm$^3$, preferably between 0.3 and 0.7 g/cm$^3$. As the core thickness becomes less than 30% or as the specific gravity is increased above 0.7 g/cm$^3$, the composite film starts to lose useful compressibility and thermal insulating properties. As the core thickness is increased above 85% or as the specific gravity becomes less than 0.3 g/cm$^3$, the composite film becomes less manufacturable due to a drop in tensile strength and it becomes more susceptible to physical damage. The total thickness of the composite film can range from 20 to 150 μm, preferably from 30 to 70 μm. Below 30 μm, the microvoided films may not be thick enough to minimize any inherent non-planarity in the support and would be more difficult to manufacture. At thicknesses higher than 70 μm, little improvement in either print uniformity or thermal efficiency is seen, and so there is not much justification for the further increase in cost for extra materials.

Suitable classes of thermoplastic polymers for the core matrix-polymer of the composite film include polyolefins, polyesters, polyamides, polycarbonates, cellulosic esters, polystyrene, polyvinyl resins, polysulfonamides, polyethers, polyimides, poly(vinylidene fluoride), polyurethanes, poly (phenylene sulfides), polytetrafluoroethylene, polyacetals, polysulfonates, polyester ionomers, and polyolefin ionomers. Copolymers and/or mixtures of these polymers can be used.

Suitable polyolefins include polypropylene, polyethylene, polymethylpentene, and mixtures thereof. Polyolefin copolymers, including copolymers of ethylene and propylene are also useful.

The composite film can be made with skin(s) of the same polymeric material as the core matrix, or it can be made with skin(s) of polymeric composition different from that of the core matrix. For compatibility, an auxiliary layer can be used to promote adhesion of the skin layer to the core.

Addenda may be added to the core matrix to improve the whiteness of these films. This would include any process which is known in the art including adding a white pigment, such as titanium dioxide, barium sulfate, clay, or calcium carbonate. This would also include adding optical brighteners or fluorescing agents which absorb energy in the UV region and emit light largely in the blue region, or other additives which would improve the physical properties of the film or the manufacturability of the film.

Coextrusion, quenching, orienting, and heat setting of these composite films may be effected by any process which is known in the art for producing oriented film, such as by a flat film process or by a bubble or tubular process. The flat film process involves extruding the blend through a slit die and rapidly quenching the extruded web upon a chilled casting drum so that the core matrix polymer component of the film and the skin components(s) are quenched below their glass transition temperatures (Tg). The quenched film is then biaxially oriented by stretching in mutually perpendicular directions at a temperature above the glass transition temperature of the matrix polymers and the skin polymers. The film may be stretched in one direction and then in a second direction or may be simultaneously stretched in both directions. After the film has been stretched it is heat set by heating to a temperature sufficient to crystallize the polymers while restraining the film to some degree against retraction in both directions of stretching.

By having at least one nonvoided skin on the microvoided core, the tensile strength of the film is increased and makes it more manufacturable. It allows the films to be made at wider widths and higher draw ratios than when films are made with all layers voided. Coextruding the layers further simplifies the manufacturing process.

The support to which the microvoided composite films are laminated for the base of the dye-receiving element made by the process of the invention may be a polymeric, synthetic paper, or cellulose fiber paper support, or laminates thereof.

Preferred cellulose fiber paper supports include those disclosed in U.S. Pat. No. 5,250,496, the disclosure of which is incorporated by reference. When using a cellulose fiber paper support, it is preferable to extrusion laminate the microvoided composite films using a polyolefin resin. During the lamination process, it is desirable to maintain minimal tension of the microvoided packaging film in order to minimize curl in the resulting laminated receiver support. The backside of the paper support (i.e., the side opposite to the microvoided composite film and receiver layer) may also be extrusion coated with a polyolefin resin layer (e.g., from about 10 to 75 g/m$^2$), and may also include a backing layer such as those disclosed in U.S. Pat. No. 5,011,814 and 5,096,875, the disclosures of which are incorporated by reference. For high humidity applications (>50% RH), it is desirable to provide a backside resin coverage of from about 30 to about 75 g/m$^2$, more preferably from 35 to 50 g/m$^2$, to keep curl to a minimum.

In one preferred embodiment, in order to produce receiver elements with a desirable photographic look and feel, it is preferable to use relatively thick paper supports (e.g., at least 120 μm thick, preferably from 120 to 250 μm thick) and relatively thin microvoided composite packaging films (e.g., less than 50 μm thick, preferably from 20 to 50 μm thick, more preferably from 30 to 50 μm thick).

In another embodiment of the invention, in order to form a receiver element which resembles plain paper, e-G- for inclusion in a printed multiple page document, relatively thin paper or polymeric supports (e.g., less than 80 μm, preferably from 25 to 80 μm thick) may be used in combination with relatively thin microvoided composite packaging films (e.g. less than 50 μm thick, preferably from 20 to 50 μm thick, more preferably from 30 to 50 μm thick).

The dye image-receiving layer of the dye-receiving element made by the process of the invention may comprise, for example, a polycarbonate, a polyurethane, a polyester, poly(vinyl chloride), poly(styrene-co-acrylonitrile), polycaprolactone or mixtures thereof. The dye image-receiving layer may be present in any amount which is effective for the intended purpose. In general, good results have been obtained at a concentration of from about 1 to about 10 g/m$^2$. An overcoat layer may be further coated over the dye-receiving layer, such as described in U.S. Pat. No. 4,775,657, the disclosure of which is incorporated by reference.

The following example is provided to further illustrate the invention.

EXAMPLE

Preparation of the Microvoided Support

Receiver support samples were prepared in the following manner. A commercially available packaging film (OPPalyte® 350 TW, Mobil Chemical Co.) was laminated to a paper support. OPPalyte® 350 TW is a composite film (38 μm thick) (d=0.62) consisting of a microvoided and oriented polypropylene core (approximately 73% of the total film thickness), with a titanium dioxide pigmented, non-microvoided, oriented polypropylene layer on each side; the void-initiating material is poly(butylene terephthalate).

Packaging films may be laminated in a variety of way (by extrusion, pressure, or other means) to a paper support. In the present context, they were extrusion-laminated as described below with pigmented polyolefin onto a paper stock support.

Control receiver support materials 1 and 2 were prepared by extrusion-lamination with chill rolls having surface roughnesses of 0.19 μm and 1.21 μm under a nip pressure of 40 psi. The pigmented polyolefin was polyethylene (12 g/m$^2$) containing anatase titanium dioxide (12.5% by weight) and a benzoxazole optical brightener (0.05% by weight). The paper stock support was 137 μm thick and made from a 1:1 blend of Pontiac Maple 51 (a bleached maple hardwood kraft of 0.5 μm length weighted average fiber length) available from Consolidated Pontiac, Inc., and Alpha Hardwood Sulfite (a bleached red-alder hardwood sulfite of 0.69 μm average fiber length), available from Weyerhauser Paper Co. The backside of the paper stock support was coated with high density polyethylene (30 g/m$^2$).

Receiver support materials 1 and 2 according to the invention were prepared in the same way as Controls 1 and 2 except that they were extrusion-laminated with chill rolls having surface roughnesses of 1.57 μm and 2.03 μm.

Preparation of Thermal Dye Transfer Receiving Element

Thermal dye-transfer receiving elements were prepared from the above receiver supports by coating the following layers in order on the top surface of the microvoided packaging film:

a) a subbing layer of Prosil® 221 and Prosil® 2210 (PCR, Inc.) (1:1 weight ratio) both are amino-functional organo-oxysilanes, in an ethanol-methanol-water solvent mixture. The resultant solution (0.10 g/m$^2$) contained approximately 1% of silane component, 1% water, and 98% of 3A alcohol;

b) a dye-receiving layer containing Makroion® KL3-1013 (a polyether-modified bisphenol-A polycarbonate block copolymer) (Bayer AG) (1.82 g/m$^2$), GE Lexan® 141-112 (a bisphenol-A polycarbonate) (General Electric Co.) (1.49 g/m$^2$), and Fluorad® FC-431 (perfluorinated alkylsulfonamidoalkyl ester surfactant) (3M Co.) (0.011 g/m$^2$), di-n-butyl phthalate (0.33 g/m$^2$), and diphenyl phthalate (0.33 g/m$^2$) and coated from a solvent mixture of methylene chloride and trichloroethylene (4:1 by weight) (4.1% solids);

c) a dye-receiver overcoat containing a solvent mixture of methylene chloride and trichloroethylene; a polycarbonate random terpolymer of bisphenol-A (50 mole %), diethylene glycol (93.5 wt %) and polydimethylsiloxane (6.5 wt. %) (2500 MW) block units (50 mole %) (0.65 g/m$^2$) and surfactants DC-510 Silicone Fluid (Dow-Corning Corp.) (0.008 g/m$^2$), and Fluorad® FC-431 (0.016 g/m$^2$) from dichloromethane.

Gloss Measurements on Test Samples

The 20 degree gloss measurements shown in Table were made with a Gardner Micro-Tri-Gloss meter according to the ASTM Standard Test Method for Specular Gloss (D 523-89).

TABLE

| | Chill Roll Roughness Average Ra (μm) | Receiver 20 Degree Gloss |
|---|---|---|
| Control 1 | 0.19 | 90.0 |
| Control 2 | 1.21 | 95.2 |
| Example 1 | 1.57 | 56.4 |
| Example 2 | 2.03 | 58.6 |

The above results show that a low gloss surface on a dye-receiver having a composite film containing a thermoplastic microvoided core layer and at least one thermoplastic surface layer can be achieved using a chill roll having a Ra of at least 1.5 μm.

The invention has been described in detail with particular reference to preferred embodiments thereof, but it will be understood that variations and modifications can be effected within the spirit and scope of the invention.

What is claimed is:

1. A process for obtaining a low gloss, dye-receiving element for thermal dye transfer comprising extrusion laminating a support with 1) a polyolefin resin and 2) a composite film comprising a microvoided thermoplastic core layer and a substantially void-free thermoplastic surface layer, said extrusion laminating process being performed with an embossed chill roll having a surface roughness average (Ra) of at least 1.5 μm and a pressure roll, and then coating said composite film with a polymeric dye image-receiving layer, thereby producing said low gloss, dye-receiving element.

2. The process of claim 1 wherein the thickness of said composite film is from 30 to 70 μm.

3. The process of claim 1 wherein the core layer of said composite film comprises from 30 to 85% of the thickness of said composite film.

4. The process of claim 1 wherein said composite film comprises a microvoided thermoplastic core layer having a substantially void-free thermoplastic surface layer on each side thereof.

5. The process of claim 1 wherein said support comprises paper.

6. The process of claim 5 wherein said paper support is from 120 to 250 μm thick and said composite film is from 30 to 50 μm thick.

7. The process of claim 7 further comprising a polyolefin backing layer on the side of the support opposite to said composite film.

8. The process of claim 1 wherein said polyolefin resin is polyethylene.

* * * * *